US007262565B2

(12) United States Patent
Fujisawa

(10) Patent No.: US 7,262,565 B2
(45) Date of Patent: Aug. 28, 2007

(54) SPIRAL ORBIT CHARGED PARTICLE ACCELERATOR AND ITS ACCELERATION METHOD

(75) Inventor: Takashi Fujisawa, Chiba (JP)

(73) Assignee: National Institute of Radiological Sciences, Chiba (JP)

( * ) Notice: Subject to any disclaimer, the term of this patent is extended or adjusted under 35 U.S.C. 154(b) by 0 days.

(21) Appl. No.: 11/397,257

(22) Filed: Apr. 3, 2006

(65) Prior Publication Data

US 2006/0175991 A1 Aug. 10, 2006

Related U.S. Application Data

(63) Continuation of application No. PCT/JP2004/015989, filed on Oct. 28, 2004.

(30) Foreign Application Priority Data

Jul. 21, 2004 (JP) ..... 2004-213129

(51) Int. Cl.
*H05H 7/04* (2006.01)

(52) U.S. Cl. ..... 315/502; 315/5.41

(58) Field of Classification Search ..... 315/5.39, 315/5.41, 5.42, 502
See application file for complete search history.

(56) References Cited

U.S. PATENT DOCUMENTS 4,006,422 A * 2/1977 Schriber ..... 315/505
6,683,426 B1 * 1/2004 Kleeven ..... 315/502

FOREIGN PATENT DOCUMENTS

JP 11-176597 7/1999
JP 2001-267099 9/2001

OTHER PUBLICATIONS

Fujisawa, T., et al. "The Radiofrequency System of the Riken Ring Cyclotron," *Nuclear Instruments and Methods in Physics Research A292* (1990), pp. 1-11.
Kustom, R.L., et al. "A 1500-MeV Fixed-Field Alternating-Gradient Synchrotron for a Pulsed-Spallation Neutron Source," *IEEE Transactions on Nuclear Science*, vol. NS-32, No. 5, Oct. 1985, p. 2672.
Aiba, M., et al. "Development of a FFAG Proton Synchrotron," *Proceedings of EPAC 2000*, Vienna, Austria, p. 581. (2000).
Kosscielniak. S., et al. "Longitudinal Dynamics in FFAG Accelerator Under Conditions of Rapid Acceleration and Fixed, High RF," IEEE, Proceedings of the 2003 Particle Accelerator Conference (2003), pp. 1831-1833, 0-7803-7739-9.

* cited by examiner

*Primary Examiner*—David Vu
(74) *Attorney, Agent, or Firm*—Blakely, Sokoloff, Taylor & Zafman; Stephen M. De Klerk

(57) ABSTRACT

According to the present invention, a non-isochronous magnetic field distribution in which the magnetic field increases as the radius increases is formed and a distribution of fixed-frequency accelerating RF voltage is formed, said non-isochronous magnetic field distribution and said distribution of fixed-frequency accelerating RF voltage being formed so that a harmonic number defined as a ratio of the particle revolution period to the period of the accelerating RF voltage decreases in integer for every particle revolution.

6 Claims, 6 Drawing Sheets

FIG.2
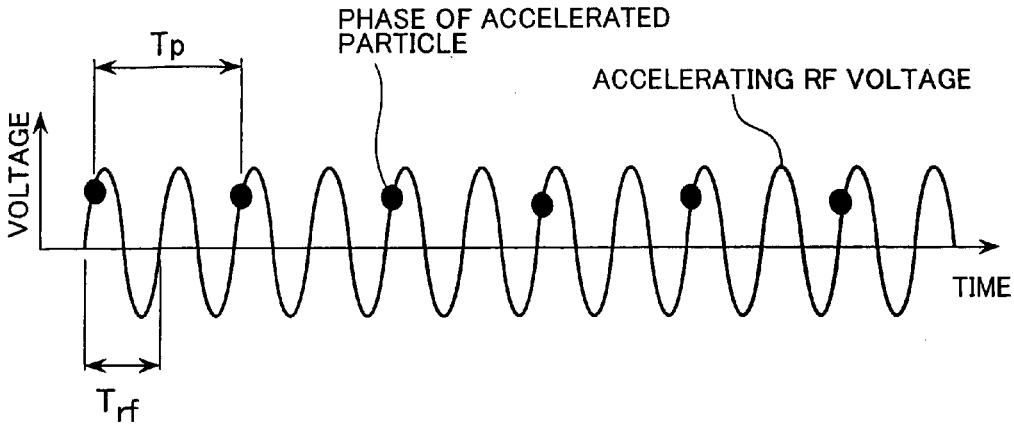
FIG.3 (修整版)
corrected
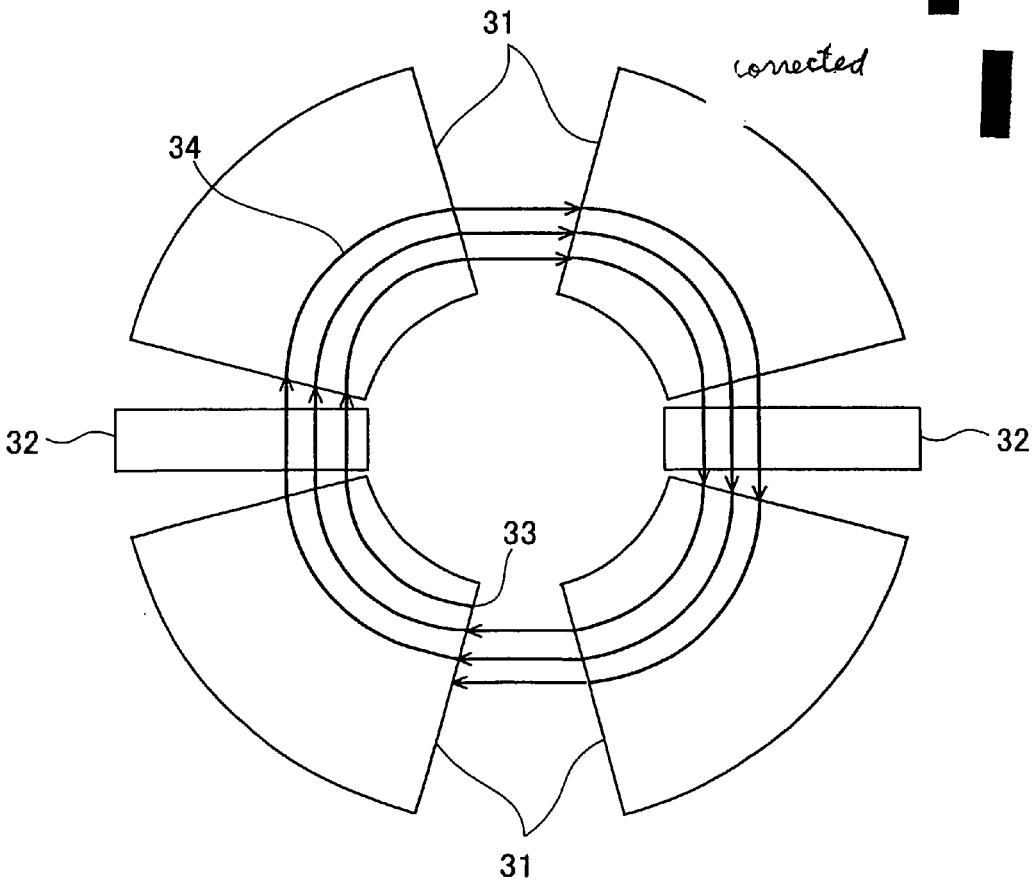

SPIRAL ORBIT CHARGED PARTICLE ACCELERATOR AND ITS ACCELERATION METHOD

CROSS-REFERENCE TO OTHER APPLICATIONS

This is a continuation of prior PCT Patent Application No. PCT/JP2004/015989, filed on Oct. 28, 2004, which claims priority from Japanese Patent Application No. 2004-213129, filed on Jul. 21, 2004, each of which is incorporated herein by reference in its entirety.

TECHNICAL FIELD

This invention relates to a charged particle accelerator, particularly, relates to a spiral orbit charged particle accelerator and an acceleration method used in the accelerator.

BACKGROUND ART

A cyclotron as a typical spiral orbit charged particle accelerator was invented by Lowlence in 1930, and the cyclotron includes a magnet 11 for generating magnetic field, accelerating electrodes 12 for generating radio-frequency (RF) voltage to accelerate charged particles, and an ion source 13 for creating charged particles as shown in FIG. 1-(A) and (B). The magnet 11 includes north pole 15 and south pole 16. The particles are accelerated on the spiral orbit 14.

The cyclotron is based on the principle that a period ($T_p$) of a charged particle circulating in a magnetic field is given by Equation (1):

$$T_p=2\pi m/eB \tag{1}$$

where $\pi$ is the ratio of circle's circumference to its diameter, m is mass of moving particle (kg), e is electric charge (C), and B is magnetic flux density on a beam trajectory (tesla).

The mass m is given by the rest mass of $m_0$ and the particle velocity of v(m/s) as follows:

$$m=m_0/(1-(v/c)^2)^{1/2} \tag{2}$$

where c is the velocity of light (approximately $3\times10^8$ m/s).

The Equation (1) shows that the revolution period of the particle is constant if the value of m/eB is constant on the beam trajectory. This distribution of magnetic field is called an isochronous magnetic field distribution. Particularly, when the velocity v is much smaller than the light velocity c, the revolution period of the particle is constant in the uniform magnetic flux density B. Thus, the period of the accelerating RF voltage should be constant. FIG. 2 is a view of waveform of the RF voltage showing a relation between phases of the particle and the RF voltage in the isochronous magnetic field. In FIG. 2, the horizontal axis is time and the vertical axis is an RF voltage.

A ratio of the particle revolution period ($T_p$) to the period ($T_{rf}$) of accelerating RF voltage is called harmonic number N and given by Equation (3).

$$N=T_p/T_{rf} \tag{3}$$

In FIG. 2, a case of N=2 is shown.

A kinetic energy E of a particle moving in a magnetic field is given by Equation (4), $$E=((ecBR)^2+m_0^2c^4)^{1/2}-m_0c^2 \tag{4}$$

where R is a radius of a trajectory curvature.

Equation (4) shows that the magnitude of BR has to be increased to increase particle energy. Thus, the magnetic field or the radius must be increased. However, a proton energy accelerated with a moderate size cyclotron is limited about 200 MeV because technical problems are encountered when the BR increases.

In order to solve the problem, a ring cyclotron as shown in FIG. 3 was developed. The ring cyclotron includes several bending magnets 31 located separately from each other and accelerating RF cavities 32 formed between the magnets 31. A low energy particle beam pre-accelerated is injected at an injection point 33 of the ring cyclotron. The injected particles are accelerated by the RF cavities and bent by the bending magnets. As a result, the accelerated particles pass on the spiral orbit 34 and extracted at an extraction point (not shown). The energy at the injection point is the injection energy and that at the extraction point is extraction energy. The radius of the trajectory curvature at the injection point is the injection radius and that at the extraction point is extraction radius. In the ring cyclotron, accelerated energy in one revolution can reaches higher than 1 MeV because the accelerating cavities and the bending magnets are spatially separated (see Non-Patent Document).

The ring cyclotron also requires the isochronous magnetic field distribution. In other wards, the field averaged on the trajectory must satisfy the condition that $T_p$ of Equation (1) is constant. The particle energy E is also given by Equation (4) using the averaged magnetic field B and the averaged radius R. An energy gain G of the ring cyclotron is given by Equation (5), $$G=\text{extraction energy/injection energy}=\{((ecB_2R_2)^2+m_0^2c^4)^{1/2}-m_0c^2\}/\{((ecB_1R_1)^2+m_0^2c^4)^{1/2}-m_0c^2\} \tag{5}$$

where $B_1$ and $B_2$ are averaged magnetic flux densities at injection and extraction points, and $R_1$ and $R_2$ are averaged radiuses of injection and extraction points.

Particularly, when the velocity v is much lower than the light velocity c or in a non-relativistic case, Equation (5) is rewritten as follows:

$$G=(B_2R_2/B_1R_1)^2 \tag{6}$$

Thus, the ratio of $R_2$ to $R_1$ is larger as the energy gain G is higher. Consequently, the size of magnets becomes larger as the energy gain becomes higher.

Non-Patent Document 1:

T. Kamei and H. Kihara, "Accelerator Science", MARUZEN Co. Ltd., Sep. 20, 1993, p. 210–211

DISCLOSURE OF THE INVENTION

PROBLEM TO BE SOLVED BY THE INVENTION

It is an object of the present invention to increase an energy gain of a spiral orbit charged particle accelerator such as a ring cyclotron without increasing magnet size.

Means for Solving the Problem

The present invention provides a spiral orbit charged particle accelerator comprising means for forming a non-isochronous magnetic field distribution in which the magnetic field increases as the radius increases and means for forming a distribution of fixed-frequency accelerating RF voltage, said non-isochronous magnetic field distribution and said distribution of fixed-frequency accelerating RF voltage being formed so that a harmonic number defined as a ratio of the particle revolution period to the period of the accelerating RF voltage changes in integer for every particle revolution.

It is preferable that said means for forming a distribution of accelerating RF voltage having fixed frequency maintains the magnitude of the accelerating RF voltage at constant regardless of the radius and said means for forming a non-isochronous magnetic field distribution increases the magnetic field as the radius increases so that the harmonic number decreases in integer for every particle revolution.

It is preferable that said means for forming a non-isochronous magnetic field distribution forms an averaged magnetic field $B_R$ at trajectory radius R given by Equation of $B_R=B_{Ri}(R/R_i)^m$ where $R_i$ is an injection radius and $B_{Ri}$ is an averaged magnetic field at the injection point and said means for forming a distribution of fixed-frequency accelerating RF voltage modifies the magnitude of the accelerating RF voltage as the radius increases so that the harmonic number decreases in integer for every particle revolution.

The present invention provides an acceleration method used in a spiral orbit charged particle accelerator, said method comprising steps of forming a non-isochronous magnetic field distribution in which the magnetic field increases as the radius increases and forming a distribution of fixed-frequency accelerating RF voltage, said non-isochronous magnetic field distribution and said distribution of fixed-frequency accelerating RF voltage being formed so that a harmonic number defined as a ratio of the particle revolution period to the period of the accelerating RF voltage changes in integer for every particle revolution.

It is preferable that said step of forming a distribution of fixed-frequency accelerating RF voltage includes a step of maintaining the magnitude of the accelerating RF voltage at constant regardless of the radius and said step of forming a non-isochronous magnetic field distribution includes a step of increasing the magnetic field as the radius increases so that the harmonic number decreases in integer for every particle revolution.

It is preferable that said step of forming a non-isochronous magnetic field distribution includes a step of forming an averaged magnetic field $B_R$ at trajectory radius R given by Equation of $B_R=B_{Ri}(R/R_i)^m$ where $R_i$ is an injection radius and $B_{Ri}$ is an averaged magnetic field at the injection point and said step of forming a distribution of fixed-frequency accelerating RF voltage includes a step of modifying the magnitude of the accelerating RF voltage as the radius increases so that the harmonic number decreases in integer for every particle revolution.

EFFECT OF THE INVENTION

The present invention makes it possible to design a spiral orbit charged particle accelerator that has much higher energy gain than that of a conventional ring cyclotron without increasing the magnet size.

BEST MODE FOR CARRYING OUT THE INVENTION

As shown in FIG. 4, the present invention is based on the principle that the magnetic field increases as the radius increases so that a ratio of the particle revolution period to the period of accelerating RF voltage, namely, a harmonic number N is decreased in integer. The condition mentioned above is represented by Equation (7), $$\Delta T_p=kT_{rf} \tag{7}$$

where $\Delta T_p$ is a decrease of particle revolution period after one revolution and k is arbitral integer. FIG. 4 shows a case of k=1.

FIG. 5 shows the above-mentioned principle comparing to a conventional isochronous ring cyclotron. From FIG. 5, it is clear that the revolution period of the accelerator of the present invention becomes shorter as the particles are accelerated in comparison with that of the conventional isochronous ring cyclotron. Thus, the energy gain of the accelerator of the present invention becomes higher than that of the conventional isochronous ring cyclotron if the magnetic fields and radiuses are the same at injection point, and the extraction radiuses are the same. The above mentioned condition is satisfied by infinite combinations of magnetic field and accelerating voltage distributions but only three examples are shown as follows:

EXAMPLE 1

Constant Accelerating Voltage

Because the accelerating voltage is constant for radiuses, the energy gain ΔE (Mev/u) for each revolution must satisfy Equation (8)

$$\Delta T_p=\alpha\cdot\Delta E \tag{8}$$

where α is constant given by acceleration condition.

Thus, the period ($T_{pn}$) after n revolutions is given by Equation (9)

$$T_{pn}=T_{p0}-n\cdot\Delta T_p \tag{9}$$

Where $T_{p0}$ is the particle revolution period at injection point.

The energy after n revolutions is given by Equation (10)

$$E_n=n\cdot\Delta E+E_0 \tag{10}$$

where $E_0$ is the injection energy (Mev/u),

From Equations (8), (9), (10), (1) and (4), the radial magnetic field distribution that satisfies Equation (7) can be calculated.

FIG. 6 shows an example of the spiral orbit charged particle accelerators to which the present invention is applied. In this example, the parameters of acceleration are as follows:

injection radius: 0.55 m
extraction radius: 1.19 m
accelerated ion: $C^{+6}$
incident Energy: 4 MeV/u
extraction energy: 35 MeV/u
particle revolution period at injection: 0.125 μs
period of accelerating electric field: 1 ns
accelerating RF voltage: 2MV As shown in FIG. 6, the magnetic field B has a non-isochronous magnetic field distribution wherein the magnetic field increases as the radius R increases. Thus, in spite of the ratio of extraction radius to injection radius of 2.16, the energy gain reaches 8.75 that is much larger than the energy gain of the same size isochronous ring cyclotron.

EXAMPLE 2

An averaged magnetic field $B_R$ at a radius R given by an Equation of $B_R=B_R i(R/R_i)^m$ where $R_i$ is an injection radius and $B_{Ri}$ is a magnetic field at the injection radius.

Because the radial magnetic field distribution is already given, the radial electric field distribution should be determined to satisfy Equation (7).

The above mentioned magnetic field condition is rewritten by:

$$B(n)=B_{Ri}(R(n)/R_i)^m \quad (11)$$

where n is the number of particle revolutions, R(n) is the averaged radius at n revolutions, B(n) is the averaged magnetic field at the radius of R(n).

The every particle revolution period must satisfies Equation (12) as hollows:

$$T_p(n+1)=T_p(n)-\Delta T_p \quad (12)$$

where n is also the number of particle revolutions, $T_p(n+1)$ is the period of particle revolution at (n+1) particle revolutions, $T_p(n)$ is the period of particle revolution at (n) particle revolutions, and $\Delta T_p$ satisfies Equation (7).

From Equations (12) and (1), the change of the particle revolution period $\Delta T_p$ is given by:

$$\Delta T_p=2\pi(m/(eB(n))-m/(eB(n+1))) \quad (13)$$

Equation (13) gives a relation between magnetic fields of (n) revolutions and of (n+1) revolutions.

From Equations (13) and (11), a relation between radiuses of R(n) and of R(n+1) is derived. Thus, the energy of particle for each revolution is calculated using Equation (4) and the required accelerating voltage for the radius can be calculated.

From the above example, it is understood that the accelerating RF voltage distribution that satisfies Equation (7) can be easily calculated, even if a different kind of magnetic field distribution is given.

FIG. 7 shows the averaged magnetic field distribution, the accelerating RF voltage distribution, and the accelerated particle energy calculated for m=3. In the calculation, the parameters of acceleration are as follows:

injection radius: 1.1 m extraction radius: 1.5 m accelerated ion: $C^{+6}$ incident energy: 4 MeV/u extraction energy: 50 MeV/u particle revolution period at injection: 0.25 μs period of accelerating RF voltage: 0.5 ns As shown in FIG. 7, the magnetic field B has a non-isochronous magnetic field distribution wherein the magnetic field increases as the radius R increases. The magnetic field increases more strongly than that of the example 1 as shown in FIG. 6 and accelerating voltage also increases as the radius increases. As a result, though the ratio of the extraction radius to the injection radius of 1.36 is smaller than that of example 1, the energy gain reaches up to 12.5 that is much larger than that of example 1.

EXAMPLE 3

When it is difficult to form the accelerating voltage distribution as shown in FIG. 7, a particle accelerator having the same magnetic field distribution as shown FIG. 7 can be designed by modulating the accelerating voltage according to the radius of the accelerated particle. FIG. 8 shows the time dependences of the accelerating voltage and of the particle energy. In this case, the accelerating voltage increases as the particles are accelerated. The obtained energy gain is the just same as that of the example 2 shown in FIG. 7 and further higher than that of example 1 shown in FIG. 6.

BRIEF DESCRIPTION OF THE DRAWINGS

FIG. 2 is a view for showing relation between particle revolution period and period of accelerating RF voltage in the cyclotron.

FIG. 3 is a plan view of a ring cyclotron.

EXPLANATION OF REFERENCE NUMERALS

Figure 1:
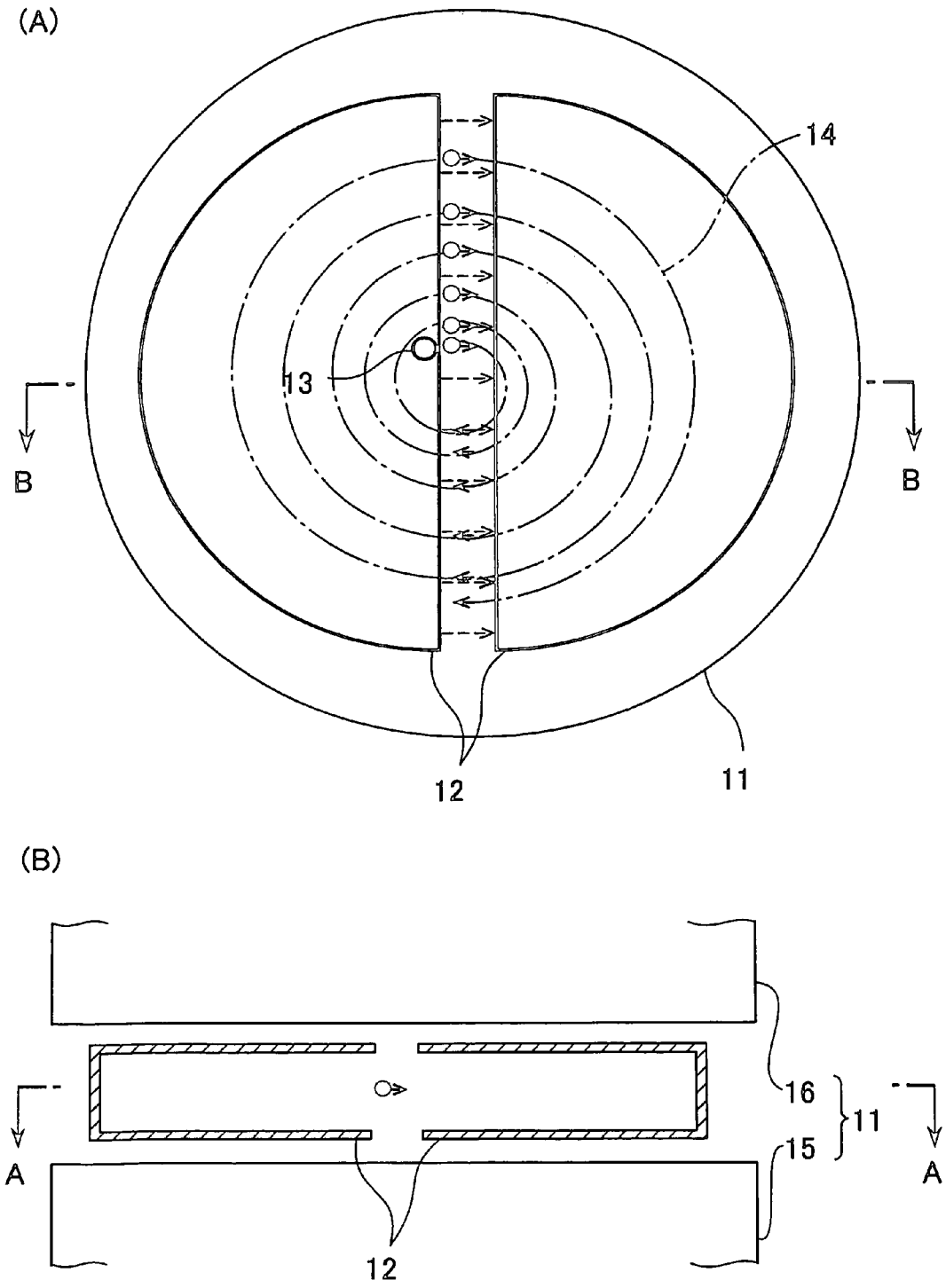
FIG. 1 is a view for explaining the principle of a cyclotron invented by Lowlence; (A) is a plan view of the cyclotron along the line A—A and (B) is a cross-sectional view of the cyclotron cut by the line B—B.
Figure 4:
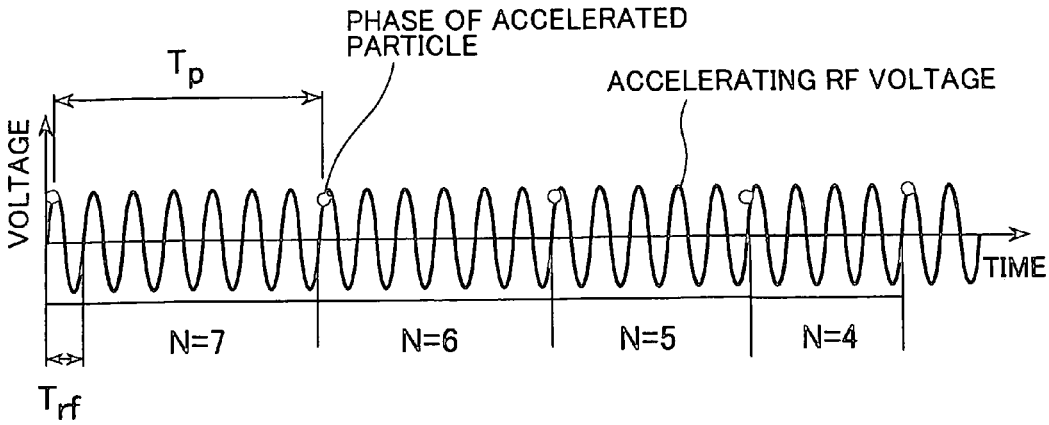
FIG. 4 is a view for explaining the principle of acceleration according to the present invention.
Figure 5:
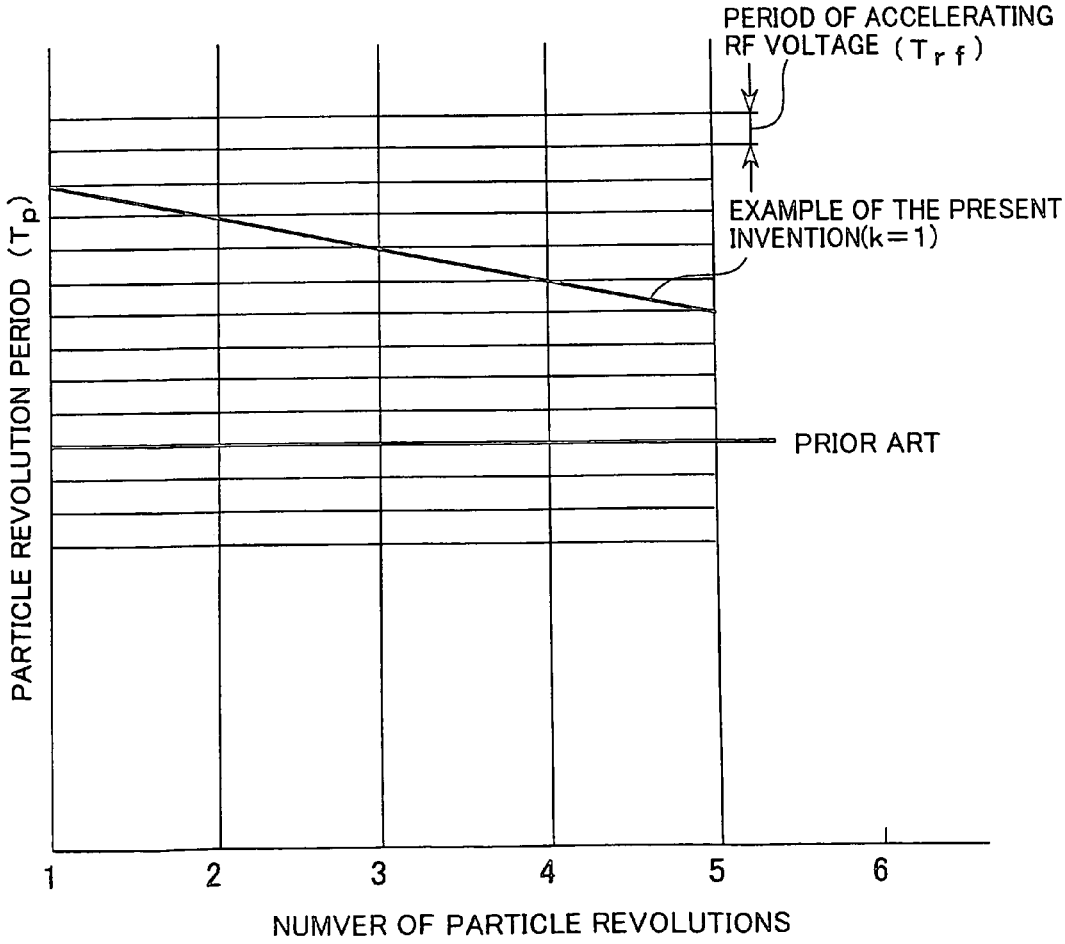
FIG. 5 is a view for showing relation between number of particle revolutions and period of particle revolution in order to compare a conventional isochronous ring cyclotron with the present invention.
Figure 6:
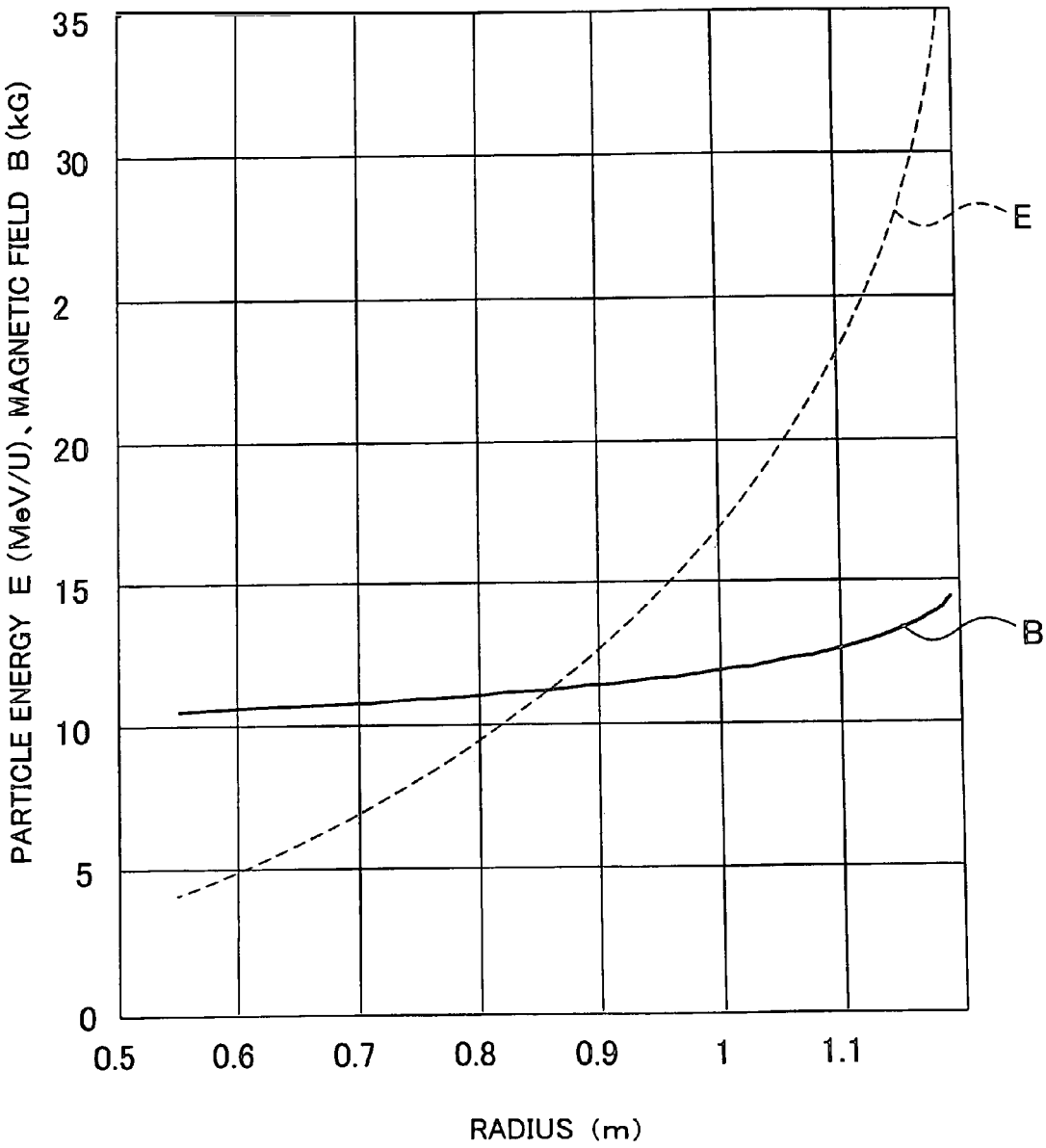
FIG. 6 is a view for showing magnetic field distribution and accelerated particle energy in one embodiment of the present invention.
Figure 7:
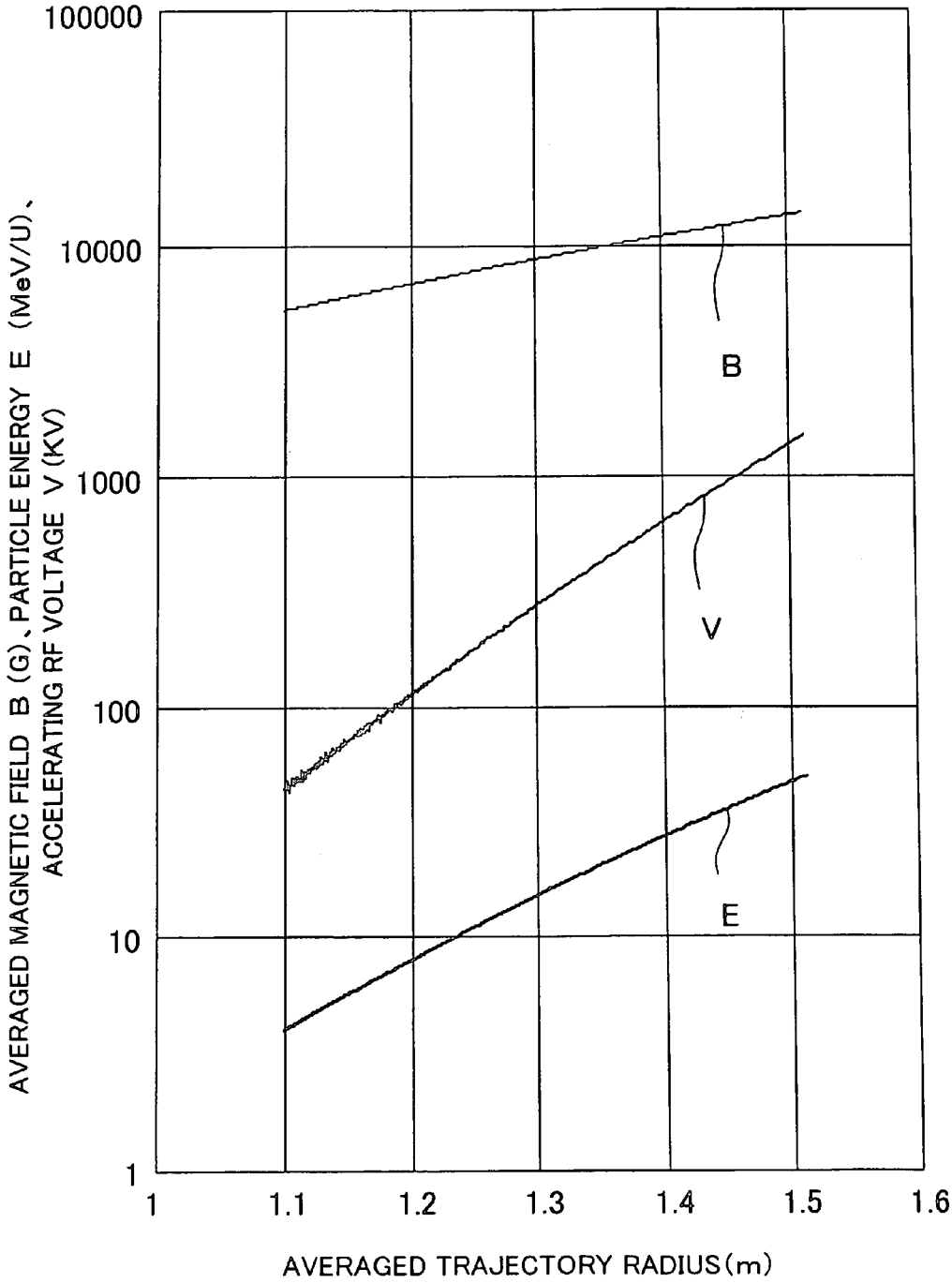
FIG. 7 is a view for showing magnetic field distribution, accelerating RF voltage distribution and accelerated particle energy in another embodiment of the present invention.
Figure 8:
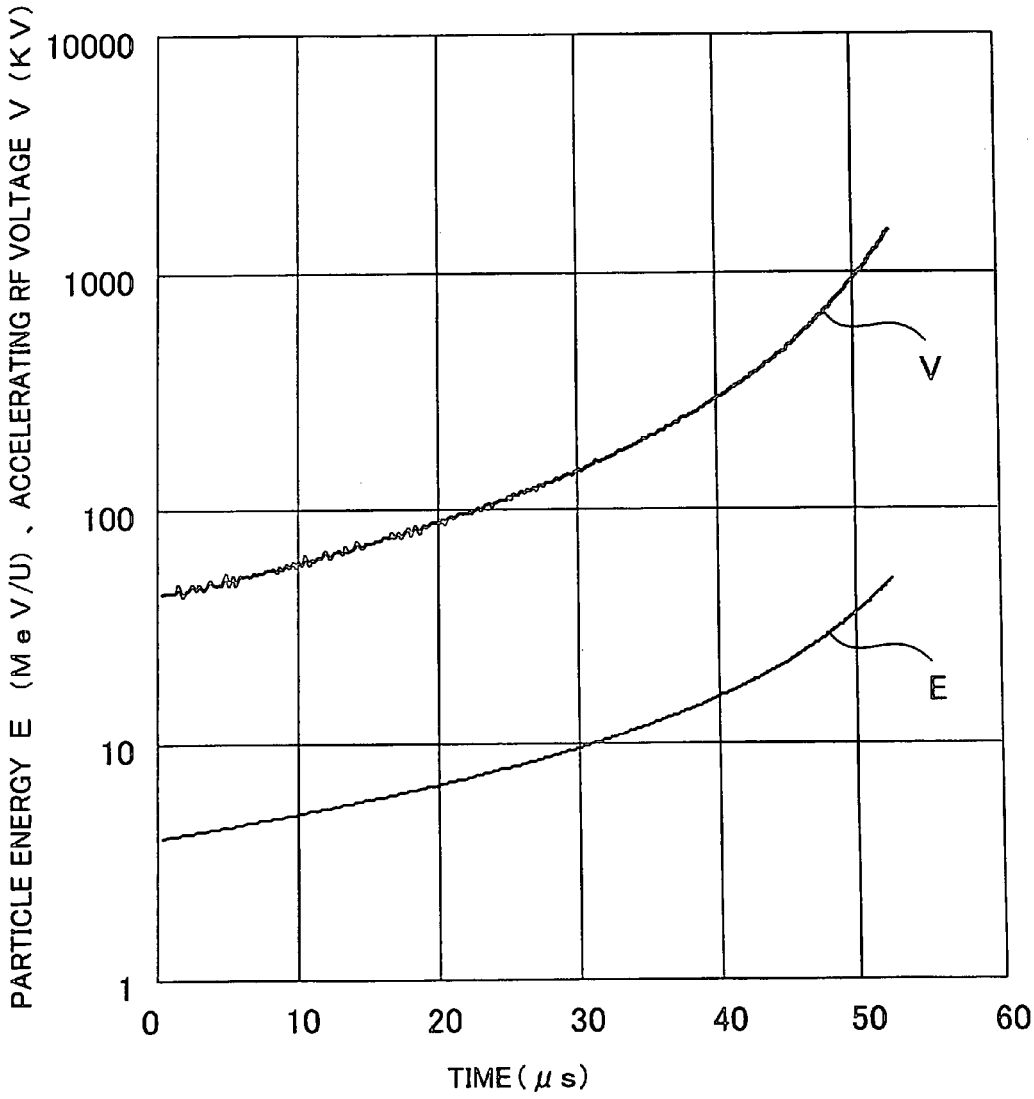
FIG. 8 is a view for showing time dependences of accelerating RF voltage and of particle energy when the accelerating RF voltage is modulated temporally in further another embodiment of the present invention.

11 magnet pole
12 accelerating electrode
13 ion source
14 accelerated beam trajectory
15 north pole of magnet
16 south pole of magnet
31 bending magnet
32 radio-frequency accelerating cavity
33 particle injection point
34 accelerated beam trajectory
$T_P$ particle revolution period
$T_{rf}$ period of radio-frequency voltage

The invention claimed is:

1. A spiral orbit charged particle accelerator comprising means for forming a non-isochronous magnetic field distribution in which the magnetic field increases as the radius increases and means for forming a distribution of fixed-frequency accelerating RF voltage, said non-isochronous magnetic field distribution and said distribution of fixed-frequency accelerating RF voltage being formed so that a harmonic number defined as a ratio of the particle revolution period to the period of the accelerating RF voltage changes in integer for every particle revolution.

2. A spiral orbit charged particle accelerator described in claim 1 wherein said means for forming a distribution of fixed-frequency accelerating RF voltage maintains the magnitude of the accelerating RF voltage at constant regardless of the radius and said means for forming a non-isochronous magnetic field distribution increases the magnetic field as the radius increases so that the harmonic number decreases in integer for every particle revolution.

3. A spiral orbit charged particle accelerator described in claim 1 wherein said means for forming a non-isochronous magnetic field distribution forms an averaged magnetic field $B_R$ at trajectory radius R given by Equation of $B^R=B_{Ri}(R/R_i)^m$ where $R_i$ is an injection radius and $B_{Ri}$ is an averaged magnetic field at the injection point and said means for forming a distribution of fixed-frequency accelerating RF voltage modifies the magnitude of the accelerating RF voltage as the radius increases so that the harmonic number decreases in integer for every particle revolution.

4. An acceleration method used in a spiral orbit charged particle accelerator, said method comprising steps of forming a non-isochronous magnetic field distribution in which the magnetic field increases as the radius increases and forming a distribution of fixed-frequency accelerating RF voltage, said non-isochronous magnetic field distribution and said distribution of fixed-frequency accelerating RF voltage being formed so that a harmonic number defined as a ratio of the particle revolution period to the period of the accelerating RF voltage changes in integer for every particle revolution.

5. An acceleration method described in claim 4 wherein said step of forming a distribution of fixed-frequency accelerating RF voltage includes a step of maintaining the magnitude of the accelerating RF voltage at constant regardless of the radius and said step of forming a non-isochronous magnetic field distribution includes a step of increasing the magnetic field as the radius increases so that the harmonic number decreases in integer for every particle revolution.

6. An acceleration method described in claim 4 wherein said step of forming a non-isochronous magnetic field distribution includes a step of forming an averaged magnetic field $B_R$ at trajectory radius R given by Equation of $B^R=B_{Ri}(R/R_i)^m$ where $R_i$ is an injection radius and $B_{Ri}$ is an averaged magnetic field at the injection point and said step of forming a distribution of fixed-frequency accelerating RF voltage includes a step of modifying the magnitude of the accelerating RF voltage as the radius increases so that the harmonic number decreases in integer for every particle revolution.

* * * * *